US008239977B2

(12) United States Patent
Sloss

(10) Patent No.: US 8,239,977 B2
(45) Date of Patent: Aug. 14, 2012

(54) AUTOMATIC RETRACTABLE HOT TUB COVER APPARATUS AND SYSTEM

(75) Inventor: Glenn Sloss, Clinton, CT (US)

(73) Assignee: Mystique Products LLC, Clinton, CT (US)

( * ) Notice: Subject to any disclaimer, the term of this patent is extended or adjusted under 35 U.S.C. 154(b) by 229 days.

(21) Appl. No.: 12/814,931

(22) Filed: Jun. 14, 2010

(65) Prior Publication Data

US 2010/0313352 A1 Dec. 16, 2010

Related U.S. Application Data

(60) Provisional application No. 61/268,811, filed on Jun. 15, 2009.

(51) Int. Cl.
*E09H 4/00* (2006.01)

(52) U.S. Cl. ..... 4/498

(58) Field of Classification Search ..... 4/498
See application file for complete search history.

(56) References Cited

U.S. PATENT DOCUMENTS

| | | | | |
|---|---|---|---|---|
| 5,566,403 | A * | 10/1996 | Black et al. | 4/498 |
| 5,819,332 | A * | 10/1998 | Perry | 4/498 |
| 6,227,592 | B1 | 5/2001 | Thacker | |
| 6,842,917 | B1 | 1/2005 | Genova | |
| 7,155,756 | B1 | 1/2007 | Helder | |
| 7,225,479 | B2 | 6/2007 | Katt | |
| 7,308,722 | B2 * | 12/2007 | Koren | 4/498 |
| 7,461,415 | B2 | 12/2008 | Buzzetti | |
| 7,950,076 | B2 * | 5/2011 | Koren | 4/498 |
| 2004/0143895 | A1 | 7/2004 | Loyd et al. | |
| 2006/0053543 | A1 | 3/2006 | Vargas | |
| 2006/0162060 | A1 | 7/2006 | Coleman | |
| 2007/0209104 | A1 | 9/2007 | Buzzetti | |
| 2008/0116708 | A1 | 5/2008 | Hardy | |

* cited by examiner

*Primary Examiner* — Huyen Le

(57) ABSTRACT

An automatic retractable and advanceable hot tub cover system comprising: a rear cross member, with a first end and a second end; a first boot assembly, in rotatable and slidable communication with the first end of the rear cross member; a second boot assembly, in rotatable and slidable communication with the second end of the rear cross member; a first rear main lift arm fixedly attached to near the first end of the rear cross member, the first rear main lift arm having a first angled end; a second rear main lift arm fixedly attached to near the second end of the rear cross member, the second rear main lift arm having a second angled end; a shackle connector with a first shackle connector end, and a second shackle connector end, the first shackle connector end rotatably attached to the first angled end; a front cover lift arm, with a front cover lift arm angled end, the front cover lift arm angled end rotatably attached to the first shackle connector end; a front cover actuator, with a front cover actuator rod, the front cover actuator rotatably attached to the first rear main lift arm, and the front cover actuator rod rotatably attached to the second shackle connector end; a front actuator/cover connector-damper, with a damper rod, the front actuator/cover connector-damper rotatably attached to a distal end of the front cover lift arm, and the damper rod rotatably attached to the second shackle connector end; and a right cover lift actuator, with a right cover lift actuator rod, the right cover lift actuator rotatably attached to the first boot assembly, and the right cover lift actuator rod rotatably attached to the first rear main lift arm.

9 Claims, 11 Drawing Sheets

AUTOMATIC RETRACTABLE HOT TUB COVER APPARATUS AND SYSTEM

CROSS-REFERENCES

The present application claims the benefit of provisional patent application no. 61/268,811 filed on Jun. 15, 2009 by Glenn Sloss, the entire contents of which are fully incorporated by reference herein.

TECHNICAL FIELD

The present invention relates to an automatic retractable hot tub cover apparatus and system, and more particularly to an automatic retractable and advanceable hot tub cover apparatus and system, which allows one to use the hot tub cover as a privacy wall, or movie screen.

BACKGROUND

Hot tubs and spas are popular fixtures that are used in many homes, hotels, and bed and breakfasts, etc. They include a large tub or small pool full of heated water and used for soaking and relaxation. Many hot tubs further include water jets for massage purposes. Hot tubs usually have several independent water circuits with one providing heating and filtration and the others driving the hydrotherapy jets.

The hot tubs are usually relatively shallow and manufactured from fiberglass-reinforced plastic that is formed into shapes that provide a variety of seating arrangements within the tub. Each seat is usually equipped with hydrotherapy jets that allow a forceful flow of water to be directed at various parts of the body. The water flow may be aerated for additional effect, and some or all of the jets may also automatically move or rotate, causing the changing pressure of the water on the body to provide a massage-like effect.

Hot tubs are frequently located outdoors. The hot tubs may be free-standing or recessed within a surrounding deck or ground. If free-standing, they are usually entered by climbing a short staircase of one or two steps and then stepping over the side of the tub onto one of the seating areas. Because many hot tubs are located outdoors, owners usually purchase covers for enclosing the hot tub when not in use. These covers help prevent dirt, leaves and other debris from entering the water. Moreover, they can provide a safety function by preventing small children from falling into the water.

These covers are quite large, and sometimes quite heavy. They frequently are about one inch, or so, in thickness and frequently are constructed of a foam material encased in a flexible covering. Thus it is often cumbersome and difficult for a user to remove the cover prior to using the hot tub and to place the cover back over the hot tub when it is no longer in use. It would be desirable, therefore, to have an improved apparatus for the automatic removal of hot tub covers. Of course, hot tub covers are probably mostly used to save energy by limiting the loss of heat from the heated water in the hot tub Thus there is a need for a device that overcomes the above listed and other disadvantages.

SUMMARY OF THE INVENTION

The disclosed invention relates to an automatic retractable and advanceable hot tub cover system comprising: a rear cross member, with a first end and a second end; a first boot assembly, in rotatable and slidable communication with the first end of the rear cross member; a second boot assembly, in rotatable and slidable communication with the second end of the rear cross member; a first rear main lift arm fixedly attached to near the first end of the rear cross member, the first rear main lift arm having a first angled end; a second rear main lift arm fixedly attached to near the second end of the rear cross member, the second rear main lift arm having a second angled end; a shackle connector with a first shackle connector end, and a second shackle connector end, the first shackle connector end rotatably attached to the first angled end; a front cover lift arm, with a front cover lift arm angled end, the front cover lift arm angled end rotatably attached to the first shackle connector end; a front cover actuator, with a front cover actuator rod, the front cover actuator rotatably attached to the first rear main lift arm, and the front cover actuator rod rotatably attached to the second shackle connector end; a front actuator/cover connector-damper, with a damper rod, the front actuator/cover connector-damper rotatably attached to a distal end of the front cover lift arm, and the damper rod rotatably attached to the second shackle connector end; and a right cover lift actuator, with a right cover lift actuator rod, the right cover lift actuator rotatably attached to the first boot assembly, and the right cover lift actuator rod rotatably attached to the first rear main lift arm.

BRIEF DESCRIPTION OF THE DRAWINGS

The present disclosure will be better understood by those skilled in the pertinent art by referencing the accompanying drawings, where like elements are numbered alike in the figures, in which.

DETAILED DESCRIPTION

Figure 1:
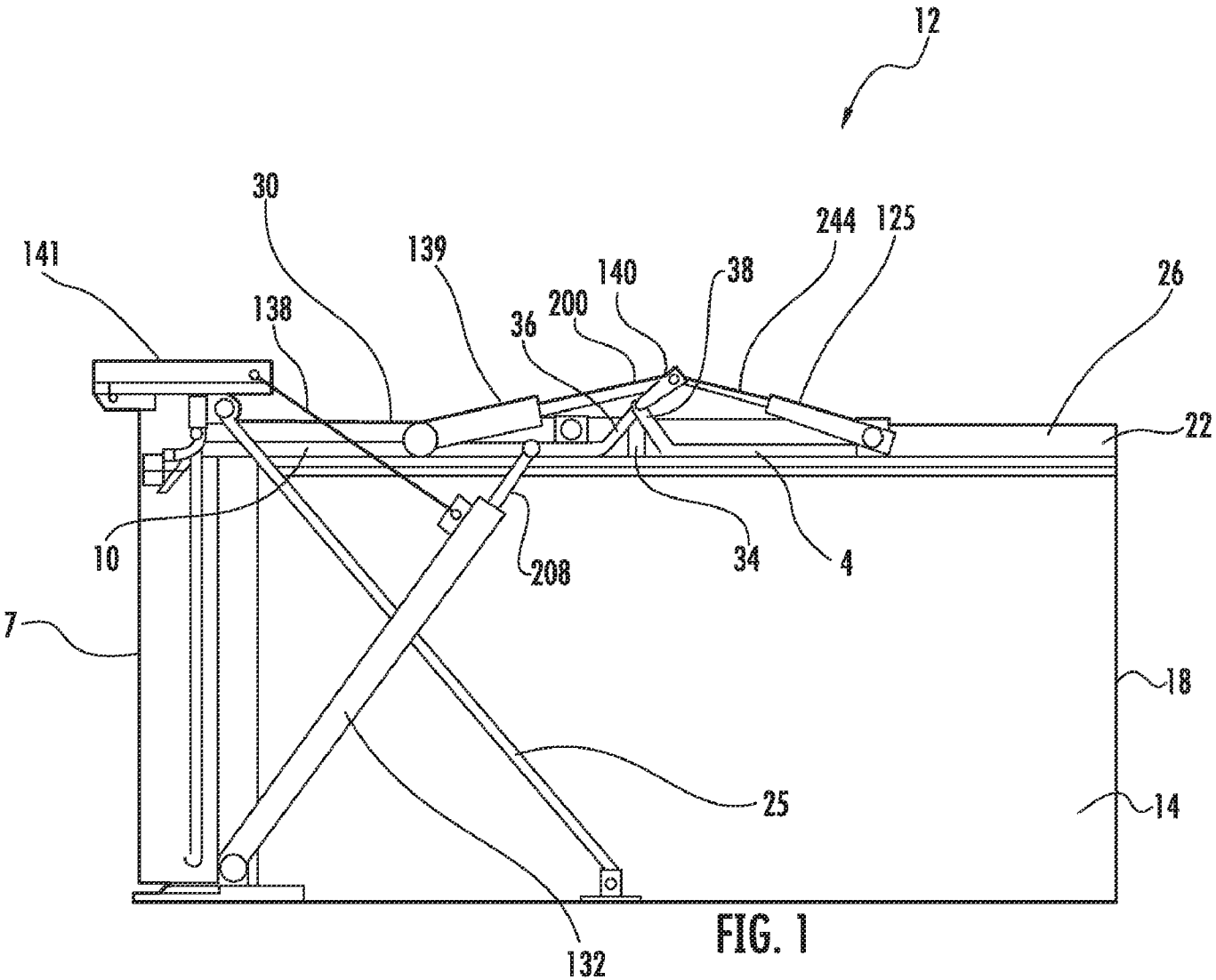
FIG. 1 is a side view of the disclosed automatic retractable hot tub cover system, with the cover on the hot tub.

In this disclosure, the term hot tub shall mean any man-made enclosed apparatus that contains water for swimming, relaxing, exercising, or bathing, such as but not limited to hot tubs, Jacuzzi's, spas, swimming spas, and swimming pools. FIG. 1 is a side view of the automatic retractable hot tub cover system 12. A wall 14 of the hot tub 18 is shown with a hot tub cover 22 already in place on the hot tube 18. The hot tub cover 22 comprises a front portion 26 and a rear portion 30. An articulable seam 34 is located adjacent to the front portion 26 and the rear portion 30, and allows the front portion 26 to pivot or rotate with respect to the rear portion 30, and vice versa. Also shown, to the rear of the hot tub 18 is the right boot assembly 7 (not visible in this view is a left boot assembly) that houses the hot tub cover assembly when the hot tub cover is removed from the top of the hot but 18 and is not being used as a privacy wall or wind screen. The right boot assembly 7 has a boot door 141 that opens, and is shown here in a closed position.

A right rear main lift arm 10 is shown rotatably connected to a front cover lift arm 4, not visible in this figure is a left rear main lift arm. The right rear main lift arm 10 comprises a mostly straight length and an angled end 36. The angled end 36 may be at an angle of between about 2° to about 60° from horizontal, and preferably about 4°. Similarly the front cover lift arm 4 comprises a mostly straight length and an angled end 38. . The angled end 38 may be at an angle of between about 2° to about 60° from horizontal, and preferably about 4° . Angled end 36 is rotatably connected to angled end 38. A right support leg 25 provides support to the right boot assembly 7. A right cover lift actuator 132 is shown connected to the base of the right boot assembly 7 and the right rear main lift arm 10. The right cover lift actuator 132 may be a motor driven lift actuator. A boot door activation rod 138 is shown attached to the boot door 141 and the right cover lift actuator 132. A front cover actuator 139 is connected to the right rear main lift arm 10 and to a shackle connector 140. The front cover actuator 139 may be a motor driven lift actuator. The shackle connector is rotatably attached to both the rear main lift arm angled end 36 and front cover lift arm angled end 38. A front actuator/cover connector-damper 125 is connected to the shackle connector 140 and to a distal end of the front cover lift arm 4. The front actuator/cover connector-damper 125 has a damper rod 244.

Figure 2:
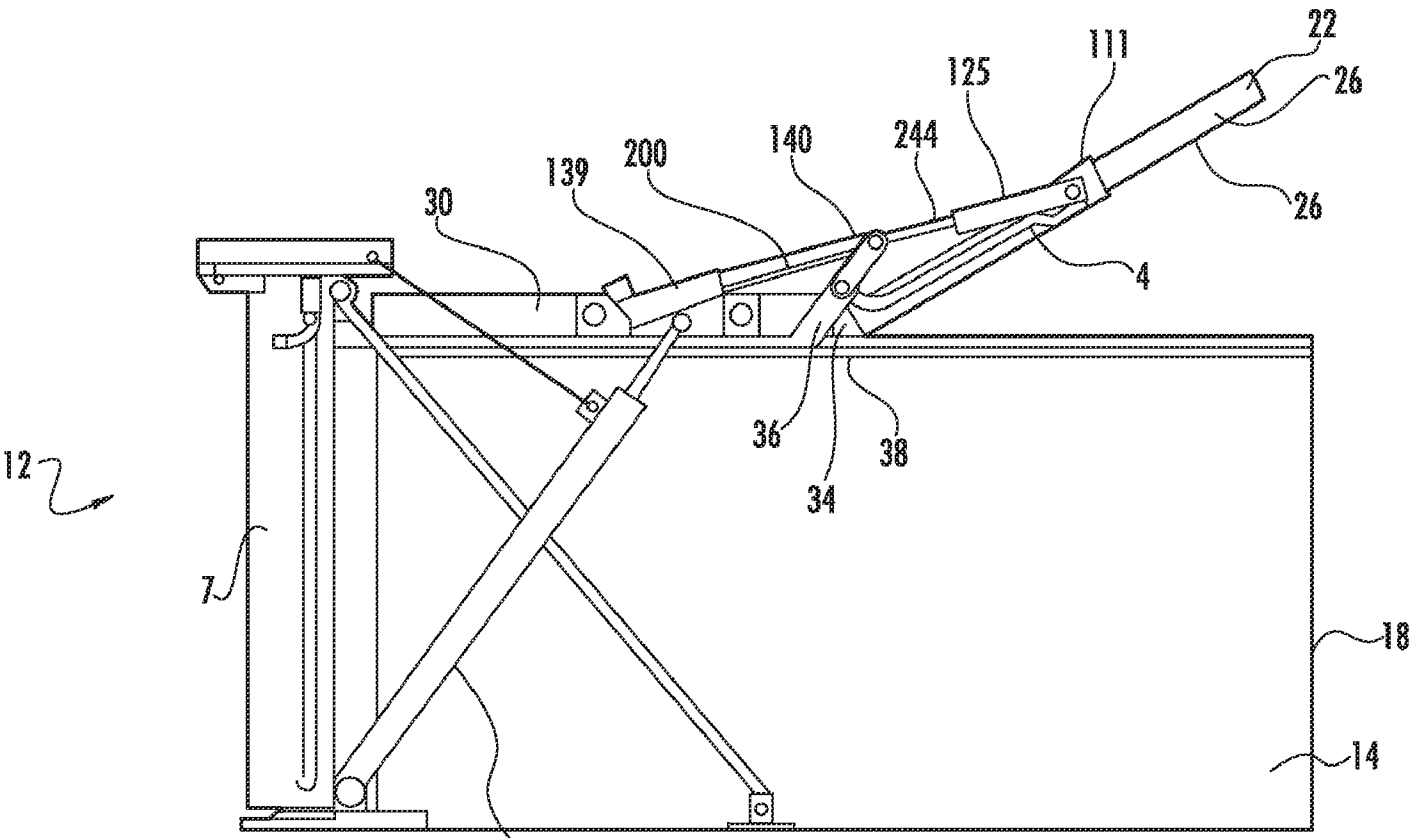
FIG. 2 is the disclosed automatic retractable hot tub cover system of FIG. 1, with the front portion of the hot tub cover being rotated up.

FIG. 2 shows a side view of the automatic retractable hot tub cover system 12, with the hot tub cover 22 beginning to be retracted. In this figure, the front cover actuator 139 has been activated and the actuator rod 200 is moving inward pulling shackle connector 140 rearward (towards the right boot assembly) along with the front actuator/cover connector-damper 125 (which serves as a link to the front cover lift arm 4).Thus the front cover lift arm 4 is pulled rearward causing the hot tub cover 22 to articulate at the seam 34, thus causing the front portion 26 to pivot upward and rearward with respect to the rear portion 30.

Figure 3:
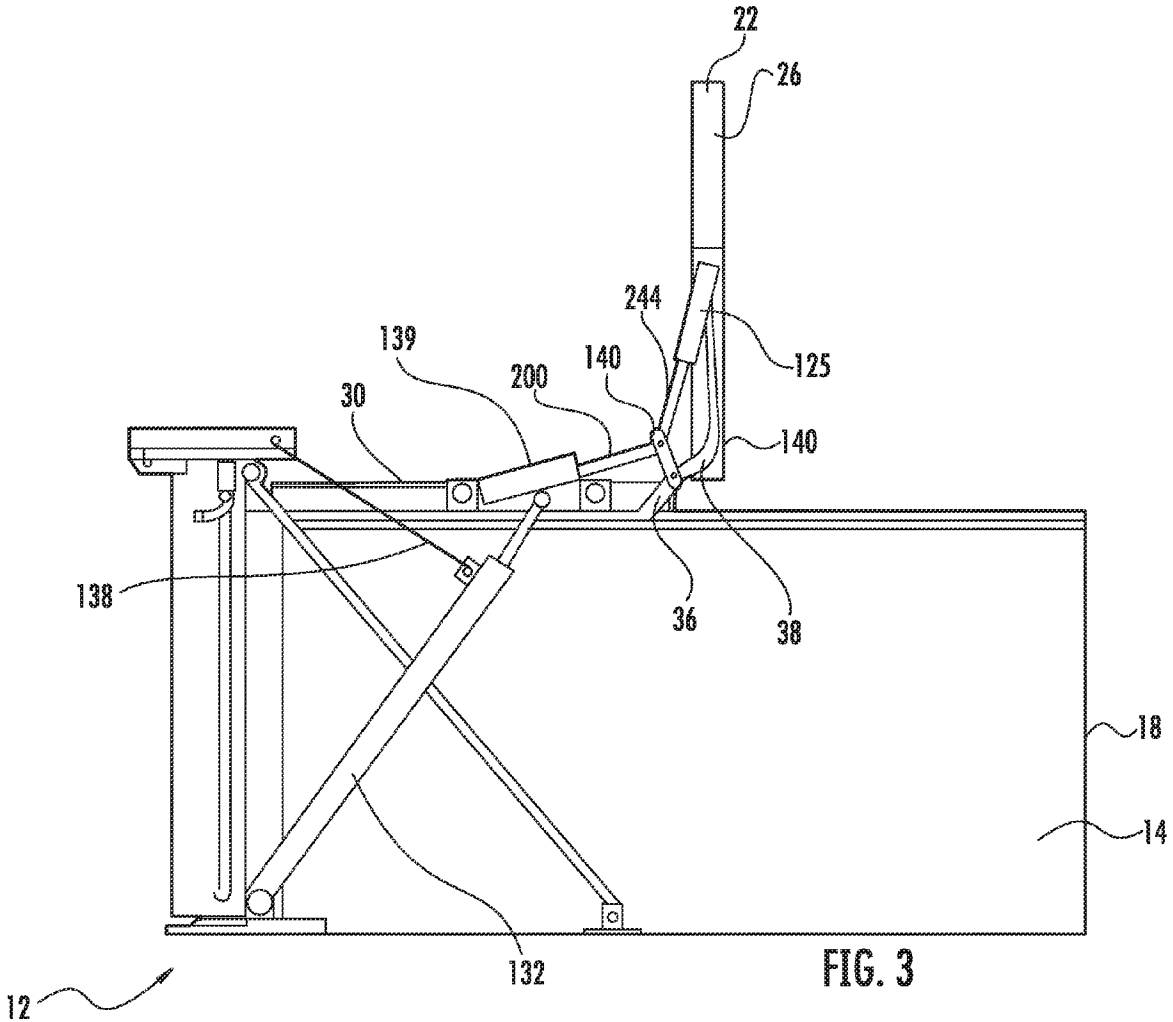
FIG. 3 is the disclosed automatic retractable hot tub cover system of FIG. 1, with the front portion of the hot tub cover being generally perpendicular to horizontal.

FIG. 3 shows a continuation of the front portion 26 being pivoted with respect to the rear portion 30, such that the front portion 26 is about 90° with respect to the rear portion. Please note that the hot tub cover system 12 can stopped at any point during the retraction or advancement of the hot tub cover.

Figure 4:
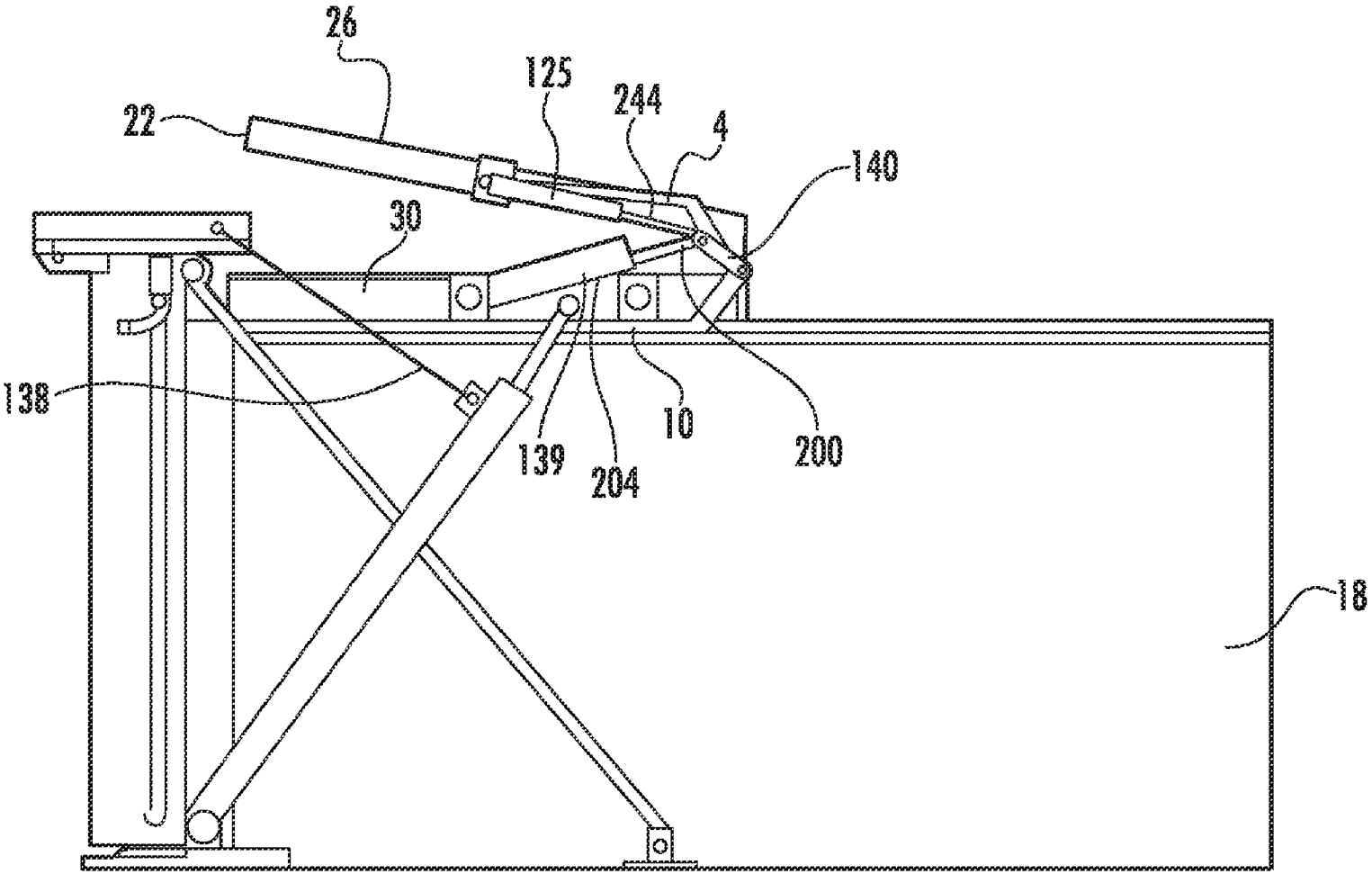
FIG. 4 is the disclosed automatic retractable hot tub cover system of FIG. 1, with the front portion of the hot tub cover being nearly adjacent to the rear portion of the hot tub cover.

FIG. 4 shows the front cover actuator rod 200 still being retracted into the front cover actuator housing 204, causing the front portion 26 to become closer to the rear portion 30 of the hot tub cover. Once the hot tub front portion 26 passes the vertical (as shown in FIG. 3), the weight of the front portion helps rotate the front portion 26 towards the rear portion 30. However, the amount the front portion 26 can rotate is limited by the shackle connector 140. In one embodiment, the amount of free movement allowed by the shackle connector 140 may be about 4 inches.

Figure 5:
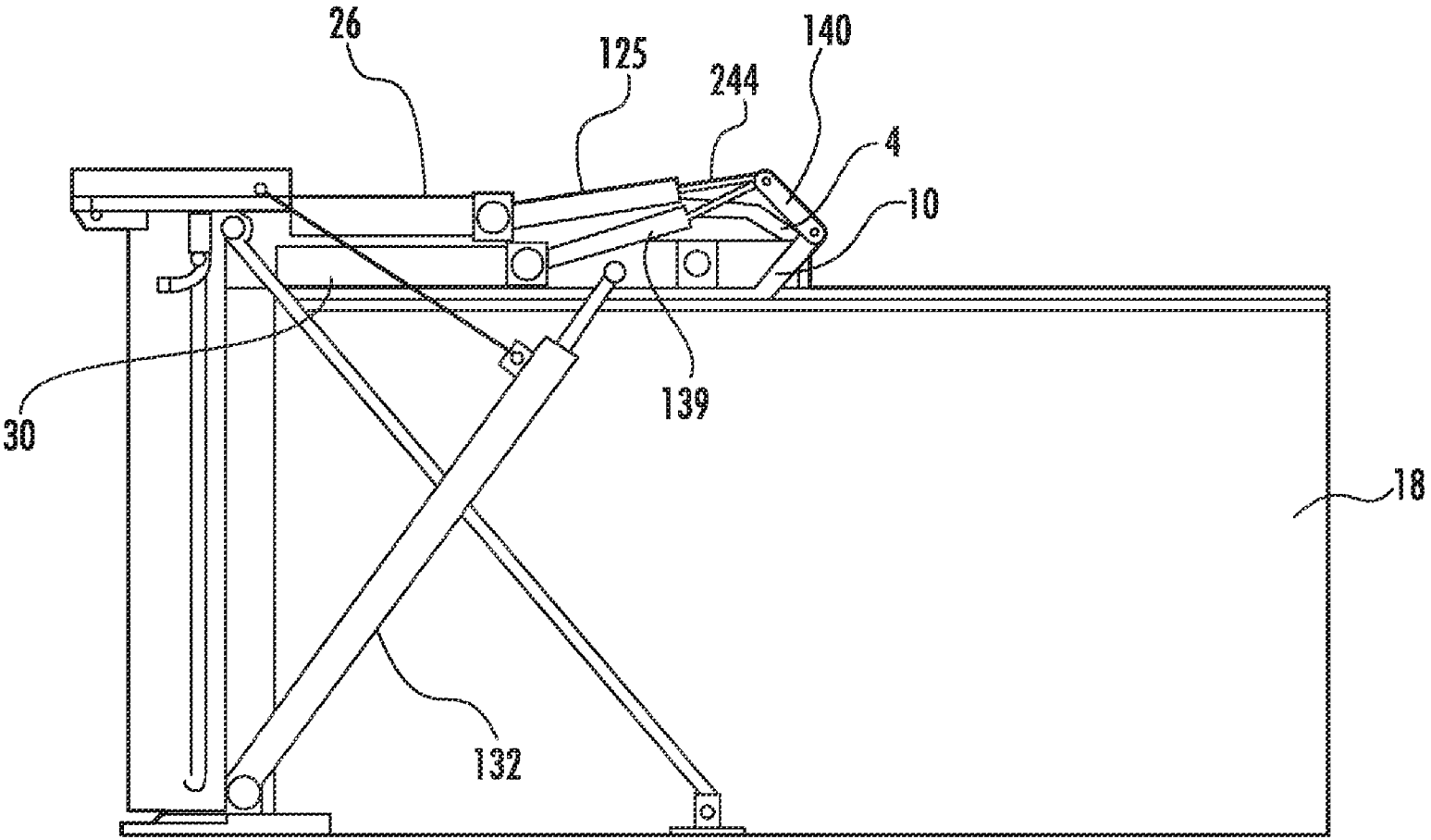
FIG. 5 is the disclosed automatic retractable hot tub cover system of FIG. 1, with the front portion of the hot tub cover abutting the rear portion of the hot tub cover.

FIG. 5 shows the front portion 26 abutting the rear portion 30 of the hot tub cover 22. At about this point, the front cover actuator 139 has stopped actuating.

Figure 6:
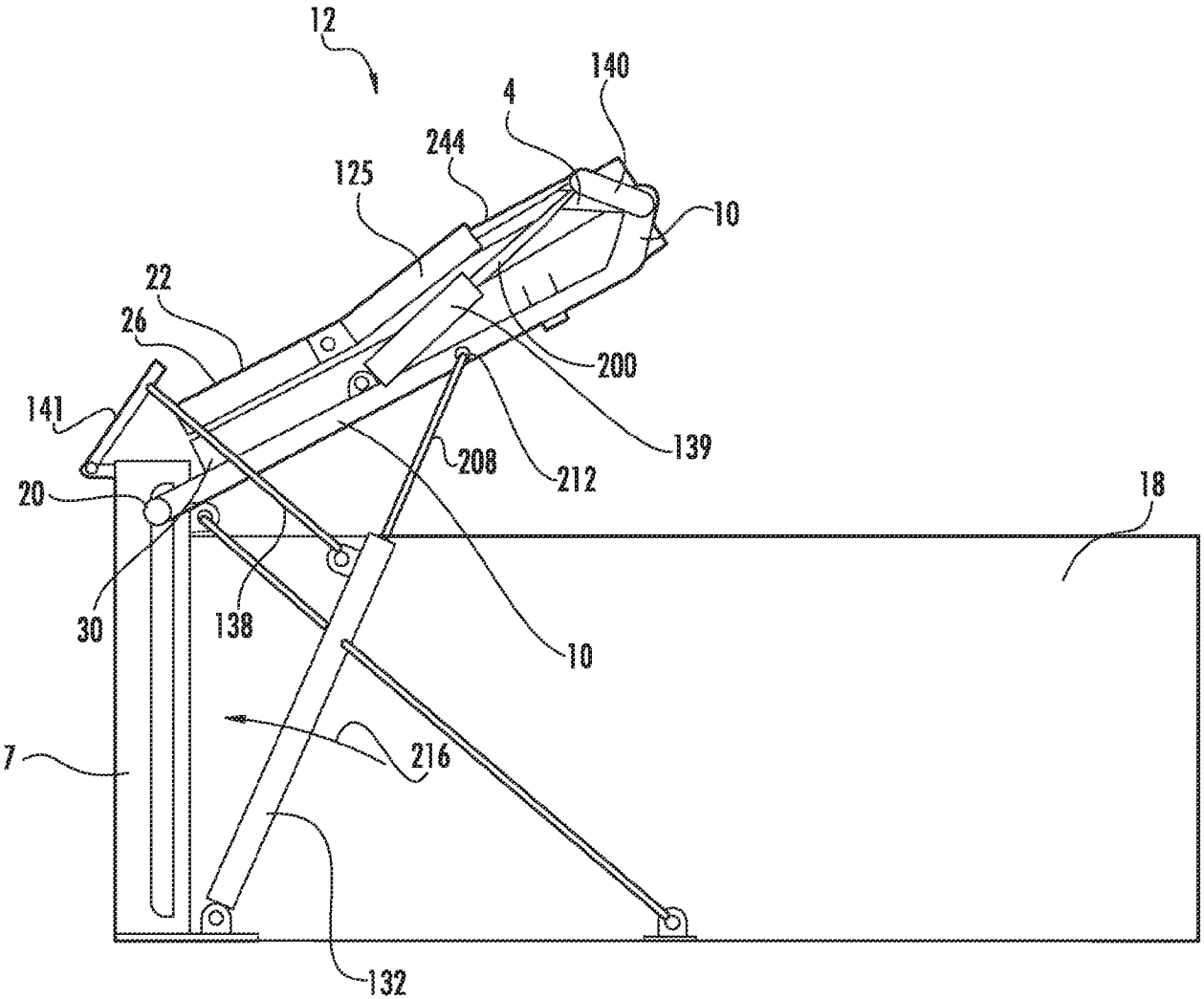
FIG. 6 is the disclosed automatic retractable hot tub cover system of FIG. 1, with the folded hot tub cover being rotated upward.

FIG. 6 shows the next phase of the hot tub cover 22 retraction. The folded over hot tub cover 22 (front portion 26 abutting the rear portion 30) is being rotated about the rear main lift arm 10 pivot point. The rear main lift arm 10 is connected to the rear cross member 20, and is generally perpendicular to the rear cross member 20. The rear cross member 20 is the pivot point of the rear main lift arm 10. The right cover lift actuator 132 (along with an optional left cover lift actuator (not visible in this view) is actuating, causing the right cover lift actuator rod 208 to extend out of the actuator 132, and because it is attached to the rear main lift arm 10 at a rod attachment point 212, it causes the rear main lift arm 10, and hot tub cover 22 to pivot up and away from the hot tub 18. In addition, due to the rotation of the rear lift arm 10, the right cover lift actuator 132 also will begin to rotate in the direction shown by the arrow 216. This causes the boot door activation rod 138 to begin to open the boot door 141. The system 12 is configured such that the boot door 141 will be completely open (i.e. is about 90° from horizontal) when the hot tub cover 22 is also about 90° from horizontal.

Figure 7:
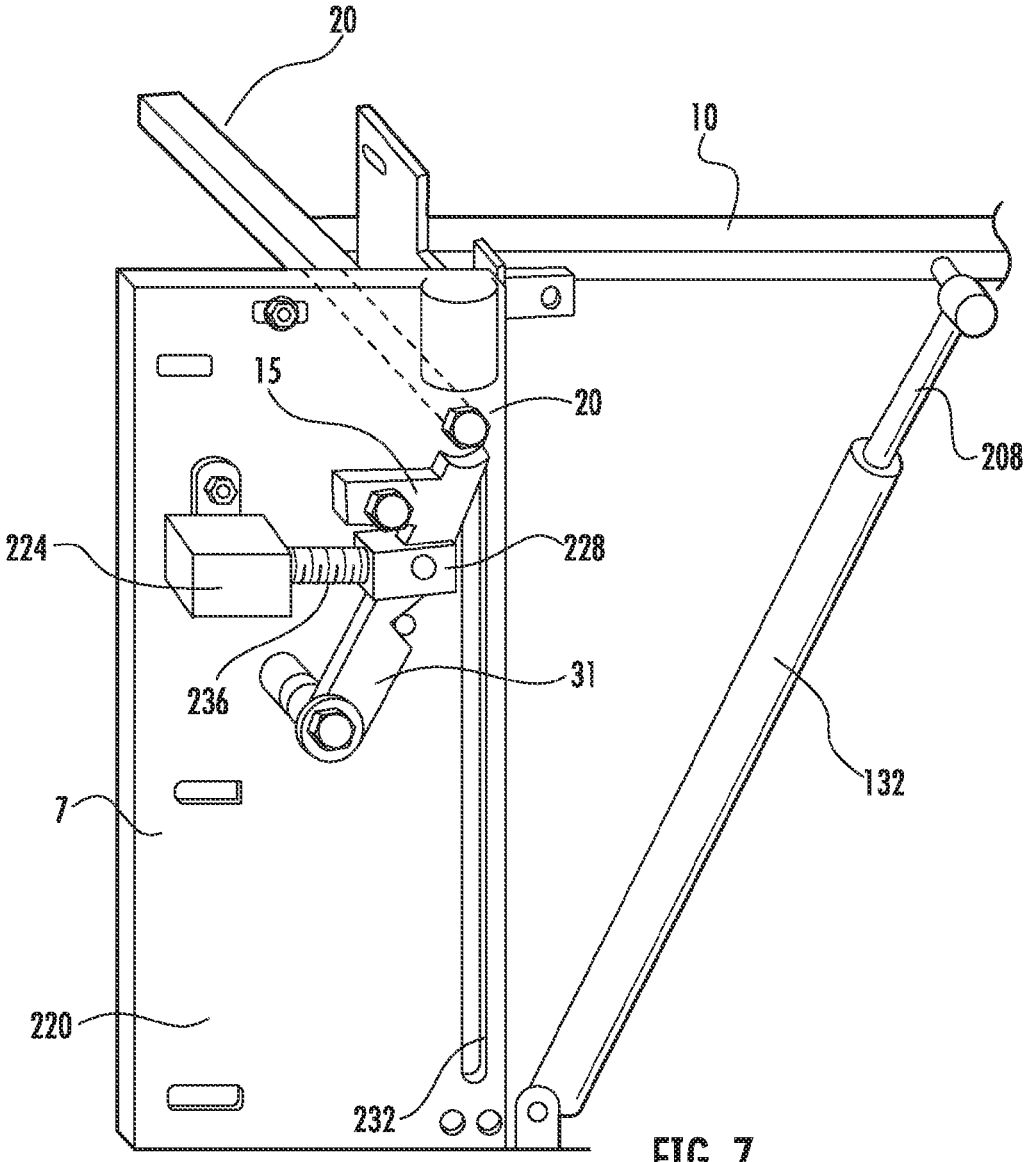
FIG. 7 is a close up perspective view of the latching system.

FIG. 7 shows a close up perspective view of some of the components located on the right boot assembly 7. The right boot wall 220 is rotatably attached to the rear cross member 20. The rear cross member 20 is attached to the right rear main arm 10 (as well as a left rear main arm, not shown in this view). The rear cross member 20 is adjacent to a latch 15, which is secured in place by a lever 31. When the latch 15 is supporting the rear cross member 20, it is known as being in a latched orientation. When actuator 132 actuates and extends right cover lift actuator rod 208 it causes the right rear main lift arm 10 and hot tub cover 22 to rotate upward about the pivot point, which is coincident with the rear cross member 20. A right activation solenoid 224 is attached to the right boot wall and is in operable communication with a right activation yoke rod 228. A yoke rod spring 236, tends to keep the yoke rod 228 and latch 15 under the and supporting the cross member, when the solenoid 224 is not activated. When the solenoid 24 activates, it pulls latch 15 and lever 31 to the left, such that the rear cross member 20 is no longer supported by the latch 15, and can travel down the slot 232. When the latch 15 is pulled to the left, the latch shall be considered as being in an unlatched orientation. While the latch 15 supports rear cross member 20, the folded hot tub cover 22 can be used as a privacy wall, see FIG. 8. In another use, the folded hot tub cover 22 may be used as a movie or projector screen, see FIG. 8. When the solenoid 24 activates, the folded hot tub cover 22 will slide down behind the hot tub 18 and into the boot assembly 7.

Figure 8:
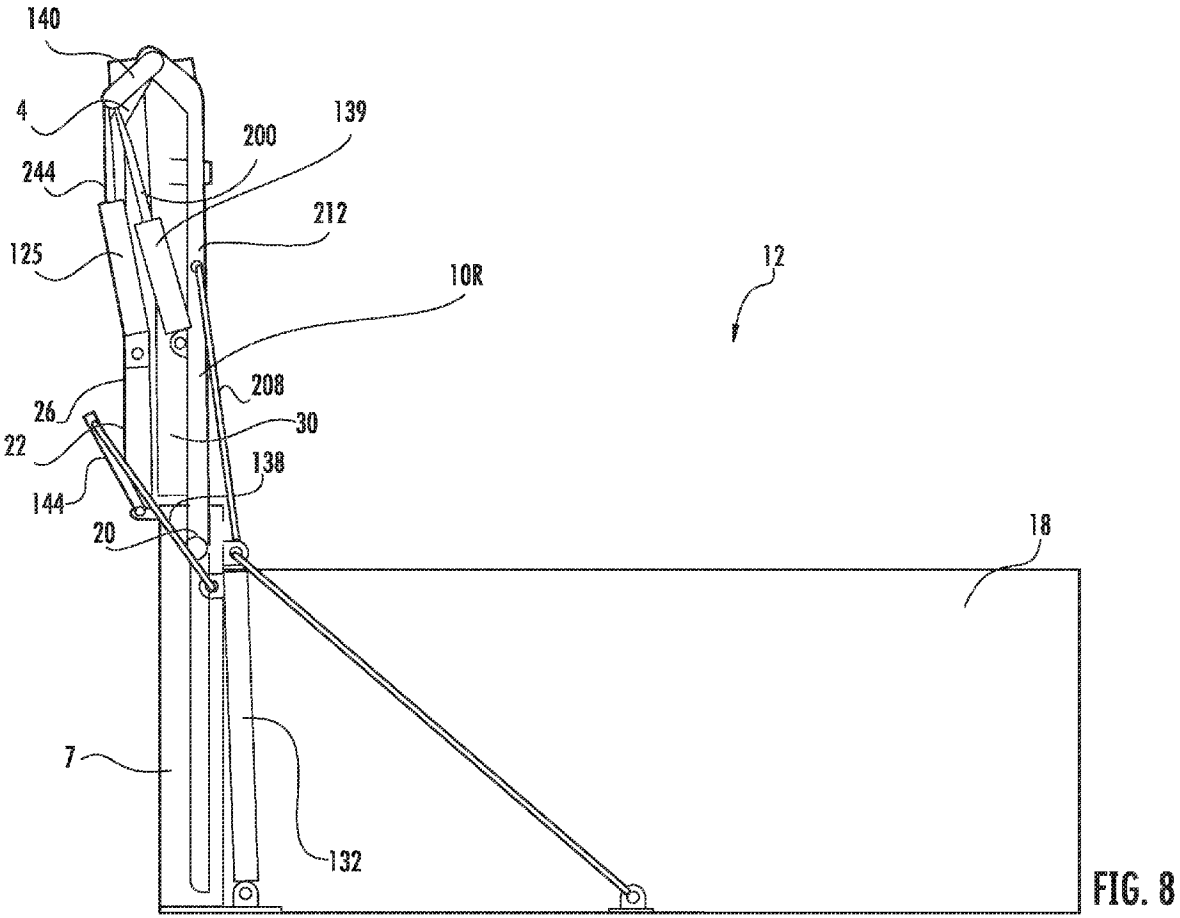
FIG. 8 is the disclosed automatic retractable hot tub cover system of FIG. 1, with the folded hot tub cover being generally perpendicular to horizontal.

FIG. 8 shows the folded hot tub cover 22 at about 90° to horizontal. It is clear that the boot door 141 is fully opened, and ready to receive the folded hot tub cover 22 down into the boot 7. In order to lower the folded hot tub cover 22 into the boot assembly 7, the solenoid 224 is activated, pulling the yoke rod 228 and the latch 15 to the left (see FIG. 7), thereby releasing the rear cross member 20. One can see in this position, that right cover lift actuator rod 208 is extended from the actuator housing 240. Therefore, from this position, the actuator 132 can be actuated to retract the rod 208, thereby lowering the entire hot tub cover 22 and associated pieces down into the boot 7. As soon as the rear cross member 20 drops beneath the latch 15, power may be shut off to the solenoid 224, thus allowing the yoke rod spring 236 to push the yoke rod back to the right. The solenoid 224 will reactivate on the reverse when the rear cross member begins to approach the latch 15.

Figure 9:
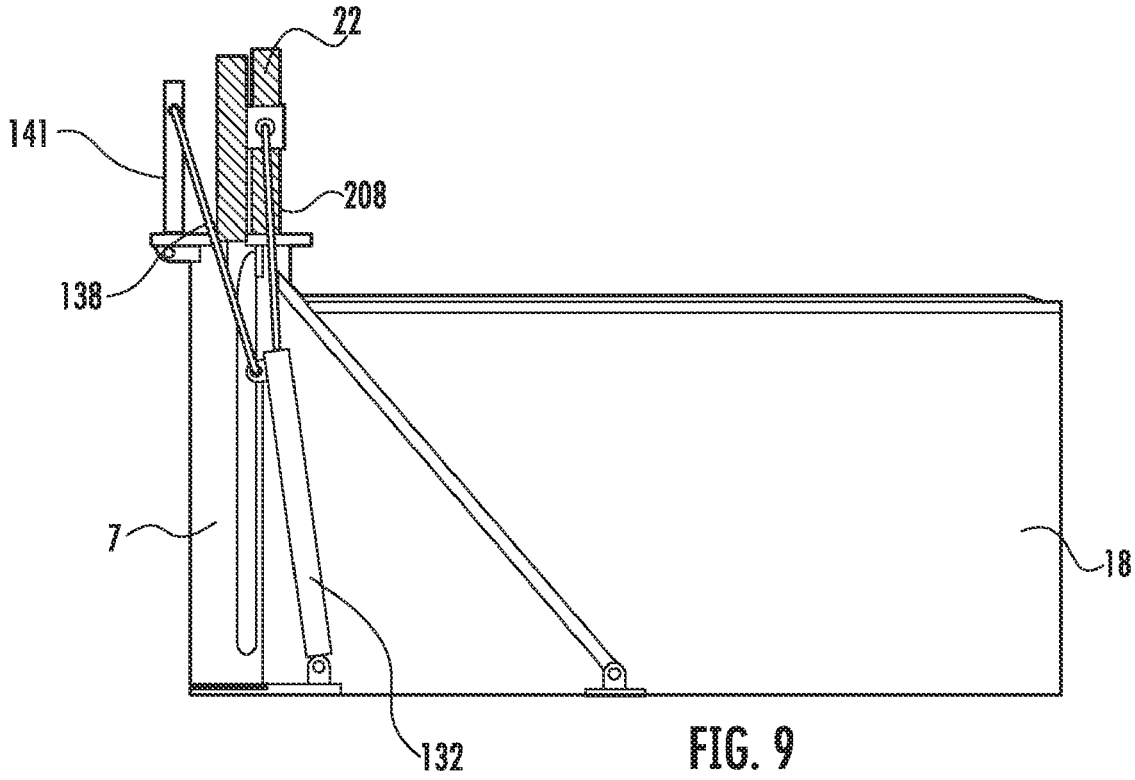
FIG. 9 is the disclosed automatic retractable hot tub cover system of FIG. 1, with the folded hot tub cover being lowered into the boots.

The folded hot tub cover 22 and associated pieces are shown in FIG. 9 being lowered into the boot assembly 7 by the action of the actuator 132 retracting the rod 208. At any point the hot tub cover 22 and associated pieces may be stopped by stopping the actuation of actuator 132, thus locking the hot tub cover 22 in place.

Figure 10:
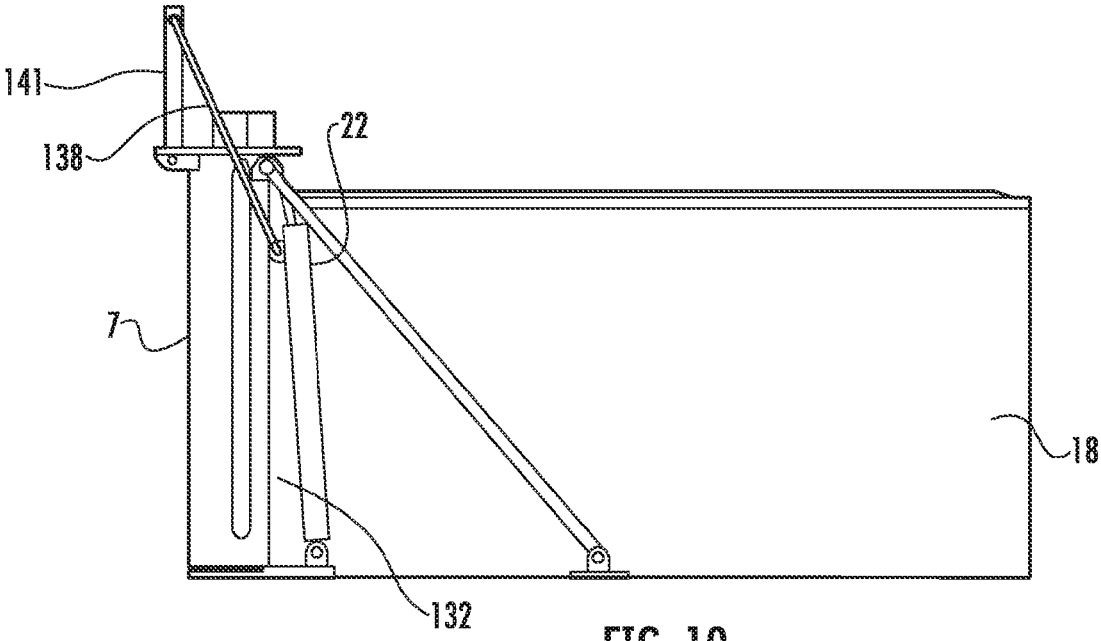
FIG. 10 is the disclosed automatic retractable hot tub cover system of FIG. 1, with the folded hot tub cover completely lowered into the boot.

FIG. 10 shows hot tub cover 22 and associated pieces fully down in the boot assembly 7 and locked in place. In order to re-cover the hot tub 18 with the hot tub cover 22, simply reverse the activation of the actuators 132 and 139.

Figure 11:
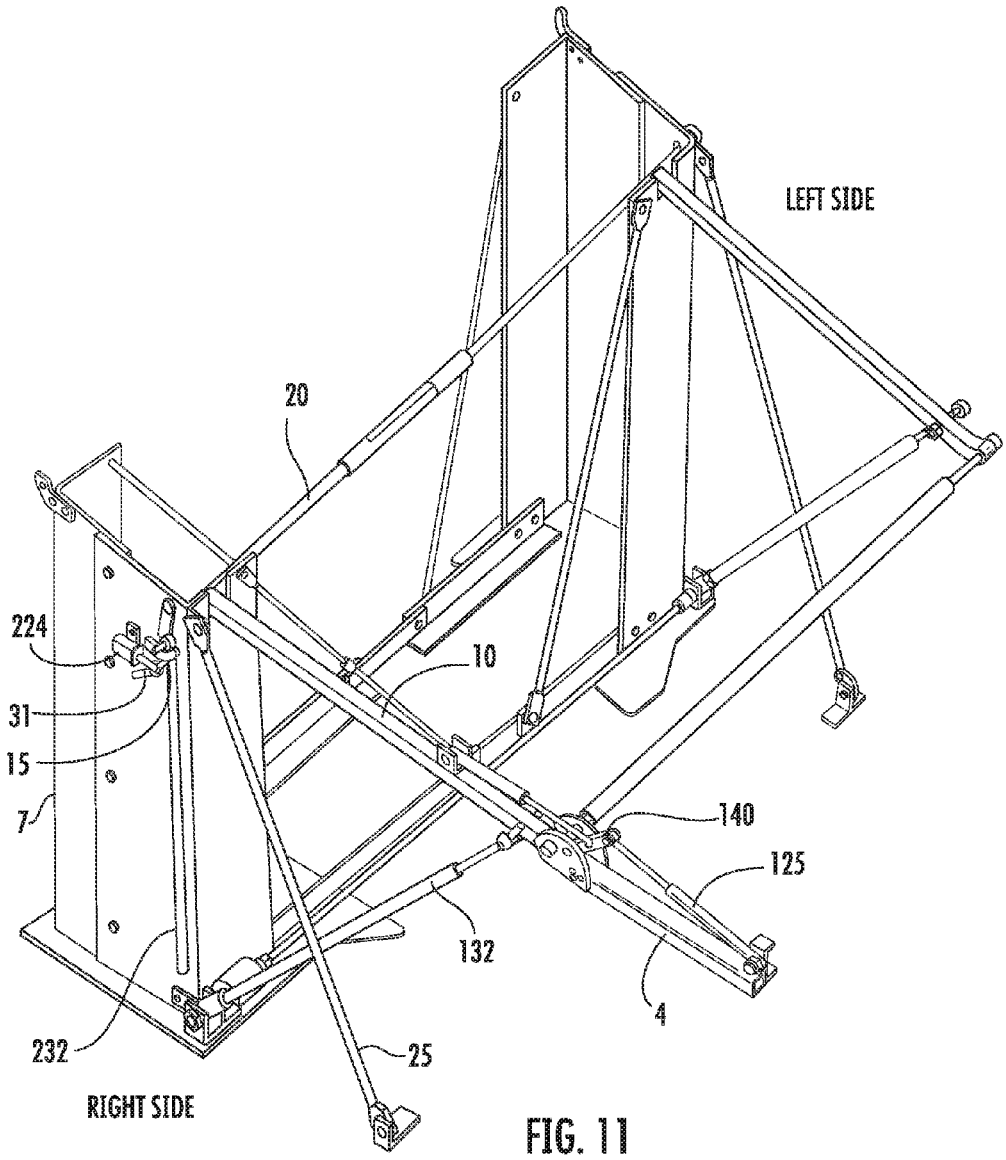
FIG. 11 is an exploded view of the disclosed automatic retractable hot tub cover system.

FIG. 11 is an exploded view of one embodiment of the automatic retractable hot tub cover system 12; with the hot tub 18 and hot tub cover 22 removed for simplicity. Please note that many of the parts on the right side of the retractable hot tub cover system 12 are duplicated on the left side of the retractable hot tub cover system 12. However, not all of the parts need to be duplicated, as shown in this embodiment.

The disclosed automatic retractable hot tub cover system 12 has many advantages. One is that the folded hot tub cover 22 can be used as an adjustable height privacy wall. In addition, the folded hot tub cover 22 can also be used for a movie or projection screen. The automatic retractable hot tub cover system 12 may have a number torque sensing devices that in the unlikely event that an object of any sort is located on the edge of the hot tub, the system immediately cease all movement. The system allows for an easy and simple means to uncover and recover a hot tub. The disclosed system may be retrofitted onto most hot tubs and spas.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. An automatic retractable and advanceable hot tub cover system comprising:

a rear cross member, with a first end and a second end;

a first boot assembly, in rotatable and slidable communication with the first end of the rear cross member;

a second boot assembly, in rotatable and slidable communication with the second end of the rear cross member;

a first rear main lift arm fixedly attached to near the first end of the rear cross member, the first rear main lift arm having a first angled end;

a second rear main lift arm fixedly attached to near the second end of the rear cross member, the second rear main lift arm having a second angled end;

a shackle connector with a first shackle connector end, and a second shackle connector end, the first shackle connector end rotatably attached to the first angled end;

a front cover lift arm, with a front cover lift arm angled end, the front cover lift arm angled end rotatably attached to the first shackle connector end;

a front cover actuator, with a front cover actuator rod, the front cover actuator rotatably attached to the first rear main lift arm, and the front cover actuator rod rotatably attached to the second shackle connector end;

a front actuator/cover connector-damper, with a damper rod, the front actuator/cover connector-damper rotatably attached to a distal end of the front cover lift arm, and the damper rod rotatably attached to the second shackle connector end; and a right cover lift actuator, with a right cover lift actuator rod, the right cover lift actuator rotatably attached to the first boot assembly, and the right cover lift actuator rod rotatably attached to the first rear main lift arm.

2. The automatic retractable and advanceable hot tub cover system of claim 1, further comprising:

a first boot wall attached to the first boot assembly;

a first vertical slot located in the first boot wall, the first vertical slot having a top end and a bottom end, the first end of the rear cross member in slideable communication with the first vertical slot;

a second boot wall attached to the second boot assembly;

a second vertical slot located in the second boot wall, the second vertical slot having a top end and a bottom end, the second end of the rear cross member in slideable communication with the second vertical slot;

a latch pivotally attached to the first boot wall, and configured to at times support the rear cross member near the top end of the first vertical slot when the latch is in a latched orientation;

a solenoid attached to the first boot wall;

a yoke rod in operable communication with the solenoid and rotatably attached to the latch;

a yoke rod spring attached to the yoke rod, the yoke rod spring tending push the yoke rod in a direction that tends to keep the latch in a latched orientation; and wherein when the solenoid is activated, the solenoid moves the yoke rod such that it causes the latch to move to an unlatched orientation.

3. The automatic retractable and advanceable hot tub cover system of claim 1, further comprising:

a boot door rotatably attached to the first boot assembly; and a boot activation rod rotatably attached to the right cover lift actuator and rotatably attached to the boot door.

4. The automatic retractable and advanceable hot tub cover system of claim 1, further comprising:

a hot tub located adjacent to the first and second boot assembly;

a hot tub cover with an articulable seam located generally across the center of the hot tub cover; a front portion of the hot tub cover located on side of the articulable seam, and a rear portion of the hot tub cover located on the other side of the articulable seam; and wherein the front portion of the hot tub cover is attached to the front cover lift arm and the rear portion of the hot tub cover is attached to the a first rear main lift arm and the second rear main lift arm.

5. The automatic retractable and advanceable hot tub cover system of claim 4, wherein the automatic retractable and advanceable hot tub cover system is configured to fold and unfold the hot tub cover about the articulable seam.

6. The automatic retractable and advanceable hot tub cover system of claim 5, wherein the automatic retractable and advanceable hot tub cover system is configured to rotate the folded hot tub cover such that it is generally perpendicular to horizontal.

7. The automatic retractable and advanceable hot tub cover system of claim 6, wherein the automatic retractable and advanceable hot tub cover system is configured to lower the generally perpendicular to horizontal folded hot tub cover into the first and second boot assembly, and wherein further the automatic retractable and advanceable hot tub cover system is configured to raise the generally perpendicular to horizontal folded hot tub cover from the first and second boot assembly.

8. The automatic retractable and advanceable hot tub cover system of claim 1, wherein the the first angled end, second angled end, and front cover lift arm angled end each have an angle with respect to horizontal of between about 2° to about 60°.

9. The automatic retractable and advanceable hot tub cover system of claim 1, wherein the the first angled end, second angled end, and front cover lift arm angled end each have an angle with respect to horizontal of about 4°.

* * * * *